US007154461B2

(12) United States Patent
Lin et al.

(10) Patent No.: US 7,154,461 B2
(45) Date of Patent: Dec. 26, 2006

(54) LIQUID CRYSTAL DISPLAY PANEL AND DRIVING METHOD THEREFOR

(75) Inventors: Ming-Tien Lin, Lujou (TW); Seok-Lyul Lee, Taipei (TW)

(73) Assignee: Hannstar Display Corporation, Taipei (TW)

( * ) Notice: Subject to any disclaimer, the term of this patent is extended or adjusted under 35 U.S.C. 154(b) by 575 days.

(21) Appl. No.: 10/753,943

(22) Filed: Jan. 7, 2004

(65) Prior Publication Data

US 2004/0160405 A1 Aug. 19, 2004

(30) Foreign Application Priority Data

Feb. 18, 2003 (TW) ..... 92103356 A

(51) Int. Cl.
*G09G 3/36* (2006.01)

(52) U.S. Cl. ..... 345/90; 345/87

(58) Field of Classification Search ..... 345/87, 345/88–95, 96, 97, 98, 99, 100, 204, 205, 345/690, 691, 692
See application file for complete search history.

(56) References Cited

U.S. PATENT DOCUMENTS

| | | | | |
|---|---|---|---|---|
| 5,247,289 | A * | 9/1993 | Matsueda | 345/98 |
| 6,677,925 | B1 * | 1/2004 | Kawaguchi et al. | 345/98 |
| 6,897,908 | B1 * | 5/2005 | Lee et al. | 349/43 |
| 7,079,102 | B1 * | 7/2006 | Miyachi | 345/94 |
| 2002/0003520 | A1 * | 1/2002 | Aoki | 345/87 |
| 2003/0001983 | A1 | 1/2003 | Nose | |
| 2004/0113881 | A1 * | 6/2004 | Kim | 345/97 |

* cited by examiner

*Primary Examiner*—Nitin Patel
(74) *Attorney, Agent, or Firm*—Seyfarth Shaw LLP

(57) ABSTRACT

During a vertical scanning period, the potential of one of the two electrodes which LC capacitors connected to each scanning line have is changed, and meanwhile the potential of the other has a coupled voltage caused from the change. The pixel electrode connected to the other one electrode of the LC capacitor also has a potential change caused from the coupled voltage so that the coupled voltage is written into the LC capacitor to turn the pixel black. That is, during one vertical scanning period, each pixel turns true black or near black from a predetermined gradation. Therefore, the LCD panel can have a sharp image, and is suitable for displaying a fast continuous movement.

17 Claims, 9 Drawing Sheets

LIQUID CRYSTAL DISPLAY PANEL AND DRIVING METHOD THEREFOR

BACKGROUND OF THE INVENTION

1. Field of the Invention

The present invention relates to a liquid crystal display (LCD) panel and a driving method thereof, and more particularly to an LCD panel suitable for the display of a dynamic image.

2. Description of the Related Art

The manufacturing technique for LCDs has improved in the industry of high contrast displays with a wide view angle. However, for dynamic images displaying a continuous movement, the image quality deteriorates due to a residual image phenomenon. Recently, there have been many relative driving methods for improving the image quality of LCDs, and the black data insertion method provided by NEC Corporation is one suitable solution upon the dynamic image issue. The prior art applies the voltage of a black datum in a sequence to the liquid crystal (LC) capacitor of each pixel during a frame period so as to have an "impulse-type" effect on the same display as a cathode ray tube (CRT) does. Therefore, a user can never see an image displayed at a certain time overlapping a previous image.

FIG. 1 shows the configuration of an LCD 10 and the gate pulses of a scanning line and scanning lines in accordance with the U.S. Publication No. 2003/0001983. The scanning signals VG1–VGn sequentially input to their corresponding scanning lines G1–Gn 12, and a data signal VD for displaying an image inputs to a scanning line D1 13. The scanning signals VG1–VGn all comprise two main gate pulses 111 and 112 during a vertical scanning period. The gate pulse 111 is applied to the scanning signal VG1 for selecting a thin film transistor (TFT) 141 so as to write a display datum 181 to the pixel electrode 151. Meanwhile, that the voltage of the pixel electrode 151 referring to the potential Vcom of a common electrode 16 is positive is defined as a positive polarity in the pixel. The scanning signals VG1–VGn, data signal VD, and potential Vcom are output from a driving circuit, which comprises a plurality of driving devices and logic devices. After the gate pulse 111 applied to the scanning line VG1 falls, the gate pulse 112 is next applied to the scanning signal VGj to turn on the TFT 142 and a black datum 182 is enabled to write a pixel electrode 152. At the same time, the display of the pixel corresponding to the pixel electrode 152 turns black from a gradation in a previous frame.

When the gate pulse 111 of the scanning signal VG1 enables the scanning line G1 of the first pixel line, the gate pulse 111 of the scanning signal VG2 will follow to enable the scanning line G2 of the second pixel line. The display datum 183 will be allowed to write a pixel electrode 152. Simultaneously, that the voltage of the pixel electrode 151 referring to the potential Vcom of a common electrode 16 is negative is defined as a negative polarity in the pixel. A black datum 184 following the display datum 183 will write the scanning line Gj+1 of the corresponding pixel line after the gate pulse 112 of the scanning signal VGj+1 outputs. In general cases, the outputs of the black data insertion and the display data are simultaneously executed far from one half of the frame period on the LCD 10. Due to the lack of sufficient charging time for writing a black datum to an LC capacitor, a plurality of the gate pulses 112 have to be separately applied to the scanning lines 12 so as to make the corresponding pixels turn true black.

FIG. 2 is a gate pulse diagram showing the datum signals and scanning signals in accordance with FIG. 1. In fact, the RC delay arises in the transmission of the scanning signal, which is especially relevant to the LCD with a large size or high resolution. A square gate pulse 111 gradually becomes a distorted gate pulse 111' on the scanning line 12 at the end of the transmission. In other words, the existence of the gate delay will shorten the charging time of a display datum, and TFT is delayed to completely turn itself off. For example, a WUGAN LCD (1,920×1,200 pixels) is suitable for a high definition television (HDTV), and the time H between the gate pulses 111 separately output from one scanning line and the next is no more than 13.31 μsec. It is necessary to satisfy the equation of H=t1+t2+t3+t4, wherein t2 of the distorted gate pulse 111' and t4 of the distorted gate pulse 112' represent the gate delay times and therefore shorten the actually working times t1 of a display datum 181 and t3 of a black datum 182.

| | t1 | t2 | t3 | t4 |
|---|---|---|---|---|
| Case 1 | 5 μ secs | 2.5 μ secs | 3.3 μ secs | 2.5 μ secs |
| Case 2 | 4 μ secs | 3 μ secs | 3.3 μ secs | 3 μ secs |

In Case 1 of the above table, t2 and t4 are equal to 2.5 μsec, and t1 and t3 are equal to 5 μsec and 3.3 μsec, respectively. In Case 2, t2 and t4 are equal to 3 μsec, and t1 and t3 are equal to 4 μsec and 3.3 μsec, respectively. The definition of t1, t2, t3 and t4 are shown in FIG. 2. In conclusion, the prior art limits the charging time of the LC capacitor to the critically write-in time of a display datum 181, so the image quality deteriorates due to this limitation. Such an insufficient charging time is the bottleneck of upgrading the size and resolution of an LCD.

SUMMARY OF THE INVENTION

An objective of the present invention is to provide an LCD panel and a driving method thereof which employs a scanning signal consisting of four potentials to make the pixels connected to a adjoining scanning line have capacitively coupled voltages. Black data resulting from the coupled voltages are written into the pixels.

The second objective of the present invention is to provide a driving circuit and a driving method for reducing the charging time of a pixel electrode so as to unify the charging status of the pixel electrodes on an LCD panel.

The third objective of the present invention is to provide an LCD panel and a driving method. Only driving devices outputting scanning signals need to be modified. It is compatible for various type LCD panels including IPS (In-Plane Switching) type and MVA (Multi-Domain Vertical Alignment) type.

The forth objective of the present invention is to provide a driving circuit and a driving method that can separately control capacitively coupled voltages. The storage capacitors of the pixels connected to each scanning line are all connected to a signal source. The voltage change of the signal source results in a coupled voltage which enables a black datum to be written into an LC capacitor.

In order to achieve the objective, the present invention discloses an LCD panel and a driving method thereof. During a vertical scanning period, the potential of one of the two electrodes which LC capacitors connected to each scanning line have is changed, and meanwhile the potential of the other has a coupled voltage caused from the change. The pixel electrode connected to the other one electrode of the LC capacitor also has a potential change caused from the coupled voltage so that the coupled voltage is written into the LC capacitor to turn the pixel black. That is, during one vertical scanning period, each pixel turns true black or near black from a predetermined gradation. Therefore, the LCD panel can have a sharp image, and is suitable for displaying a fast, continuous movement.

Wherein either the one of the two electrodes which LC capacitors connected to each scanning line have is connected to a previous scanning line of which an applied scanning signal has a potential change accompanied with the occurrence of the coupled voltage, or based on the storage capacitors of the pixels connected to each scanning line all connected to a scanning line, the coupled voltage caused by the potential change of the scanning line can write a black datum into the LC capacitor.

BRIEF DESCRIPTION OF THE DRAWINGS

The invention will be described according to the appended drawings in which.

PREFERRED EMBODIMENT OF THE PRESENT INVENTION

Figure 1:
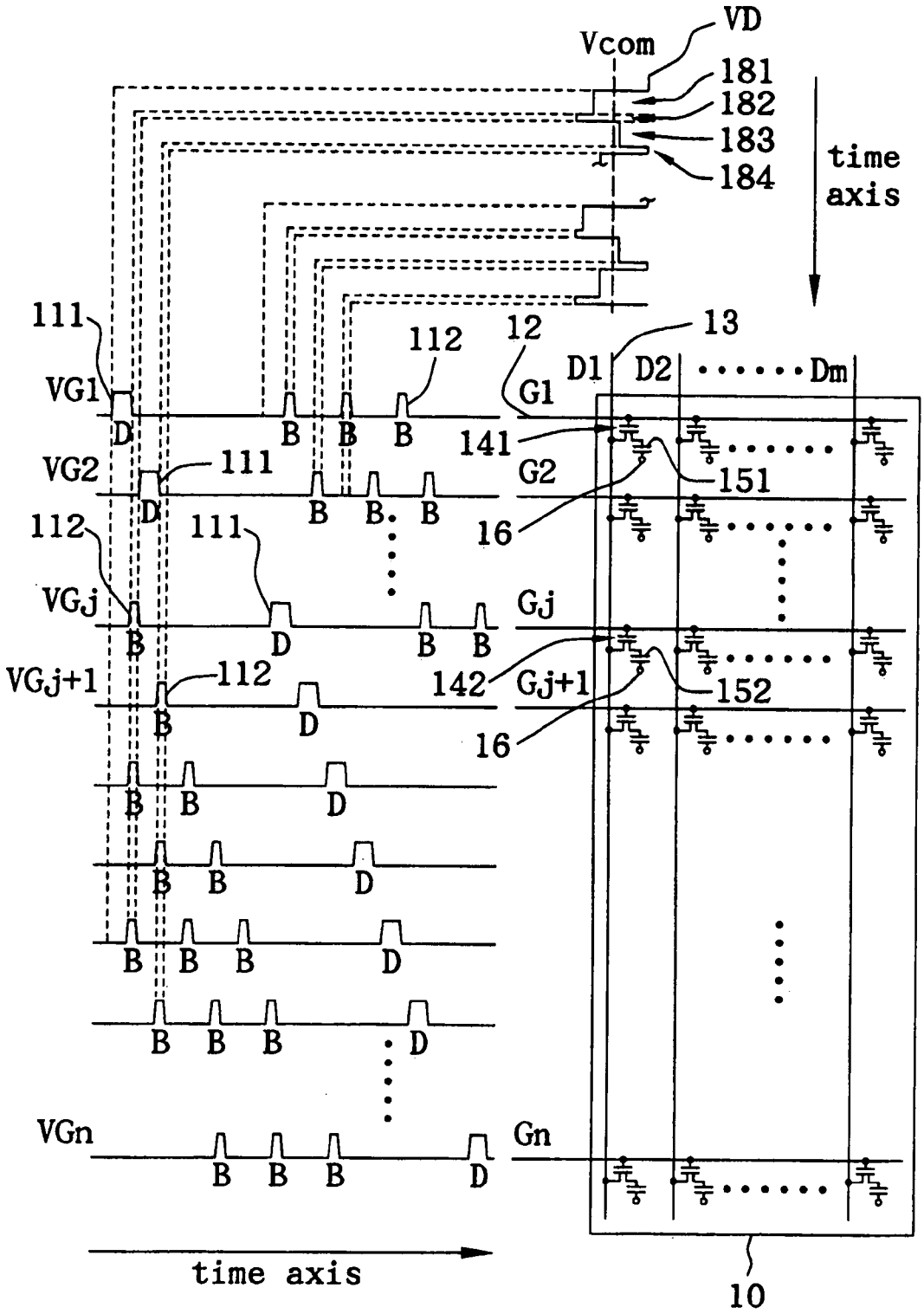
FIG. 1 (Background Art)
FIG. 1 shows the configuration of an LCD and the gate pulses output from a scanning line and scanning lines in accordance with U.S. Publication No. 2003/0001983.
Figure 2:
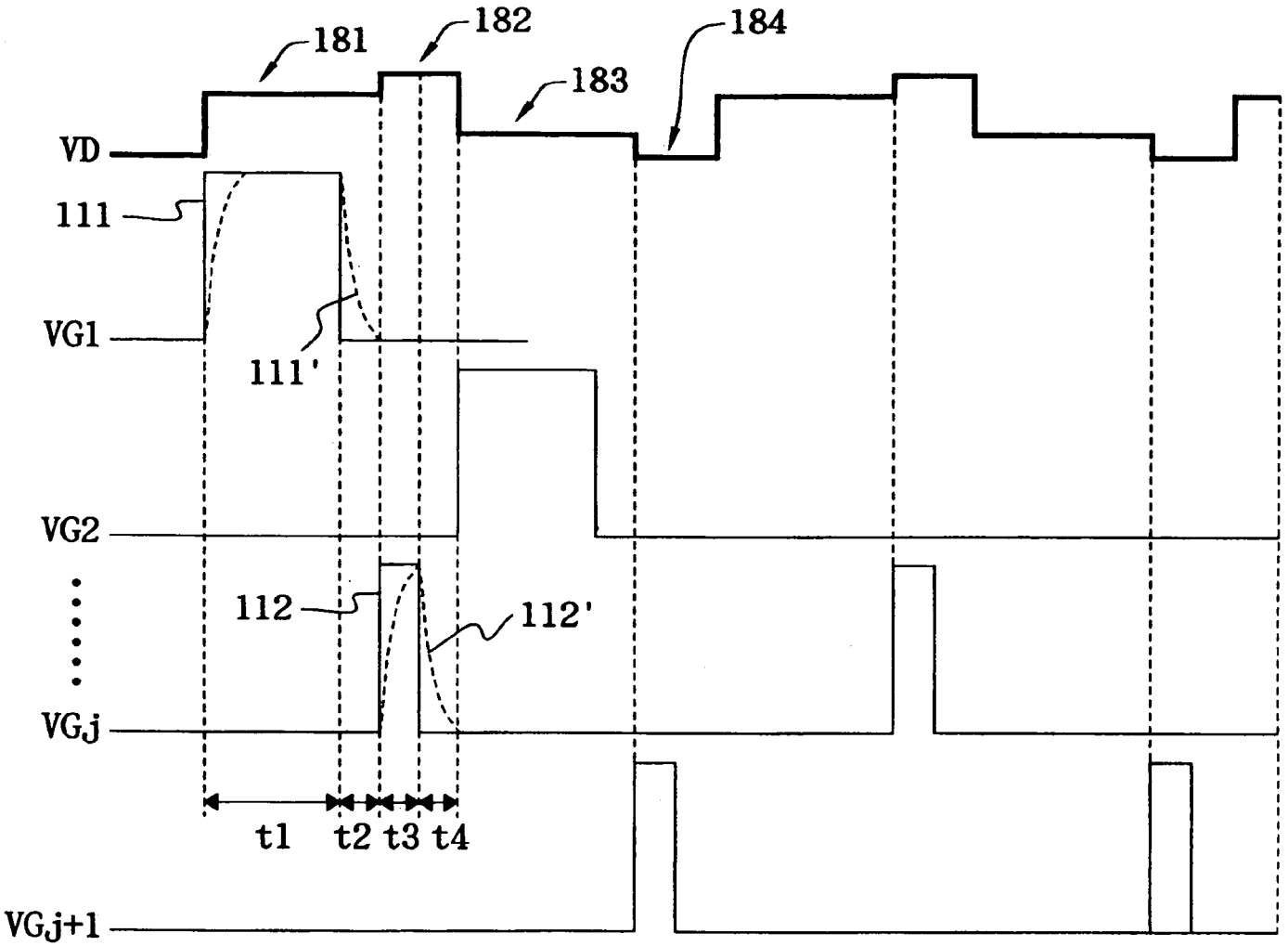
FIG. 2 (Background Art)
FIG. 2 is shows the gate pulses output from a scanning line and scanning lines in accordance with FIG. 1.
Figure 3:
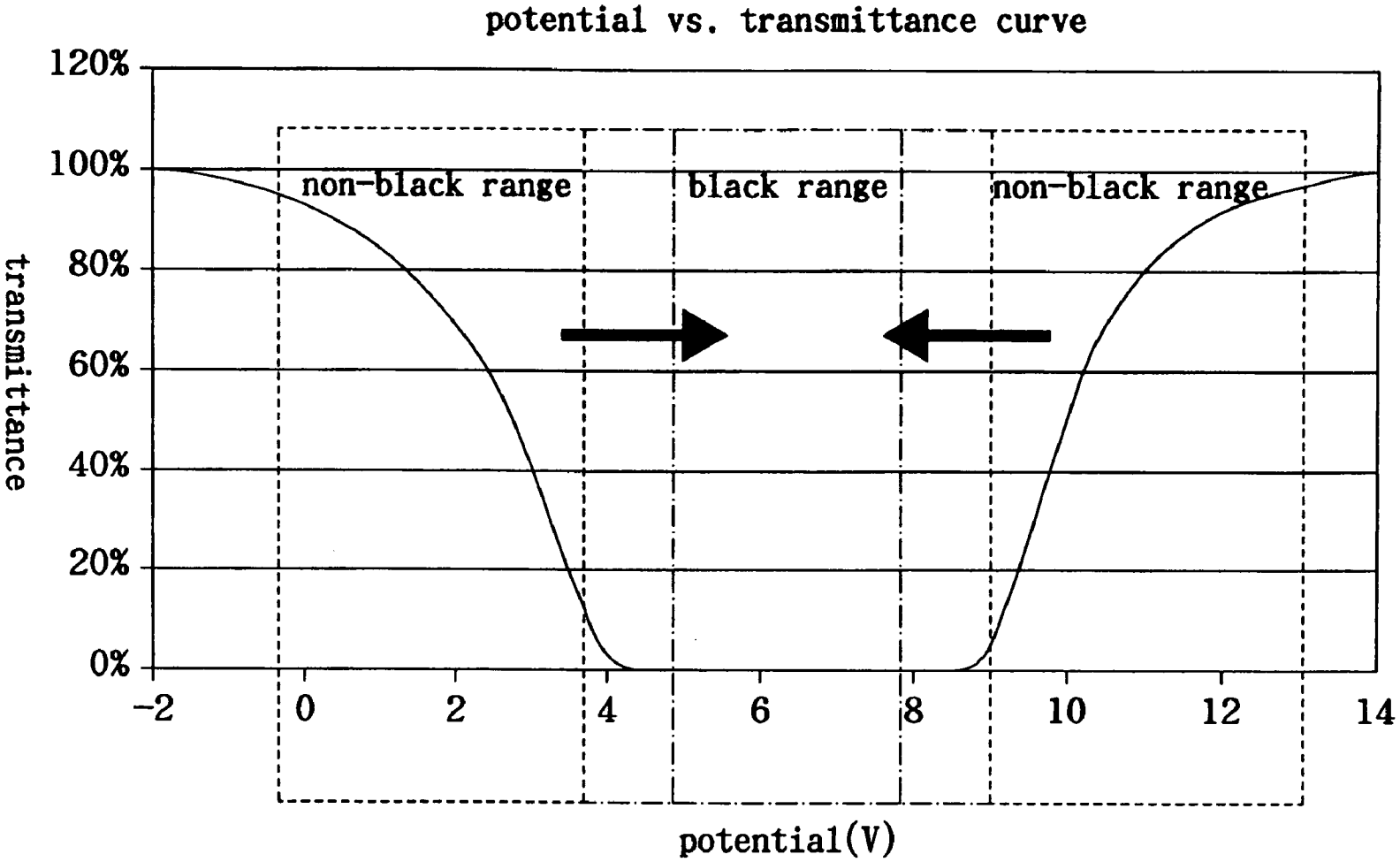
FIG. 3 explains the basic rule of a black datum written into an LCD panel in accordance with the present invention.

FIG. 3 explains the basic rule of a black datum written into an LCD panel in accordance with the present invention, wherein the transverse axis represents the potential of a pixel electrode and the longitudinal axis represents the transmittance of light through LC molecules. An electrical field exists between a pixel electrode and a common electrode, and can turn LC molecules to a predetermined direction. The voltage vs. transmittance curve is like a symmetric bath-tube shape whose middle symmetric point has a corresponding potential representing the potential of the common electrode. The left half curve and right half curve at the symmetric point respectively show the variations of the transmittance of a pixel defined as a positive polarity and a negative polarity.

The middle segment of the curve where the transmittance is zero or approximately zero is called a black range. That is, the pixel displays black when the potential of the pixel electrode varies in the black range. Two non-black ranges exist in the left and right segment of the curve. The basic rule of the present invention is to have a coupled voltage on the pixel electrode, and the coupled voltage can change the potential of the pixel electrode from the non-black range to the black range so that the pixel turns true black or near black from a predetermined gradation.

Figure 4:
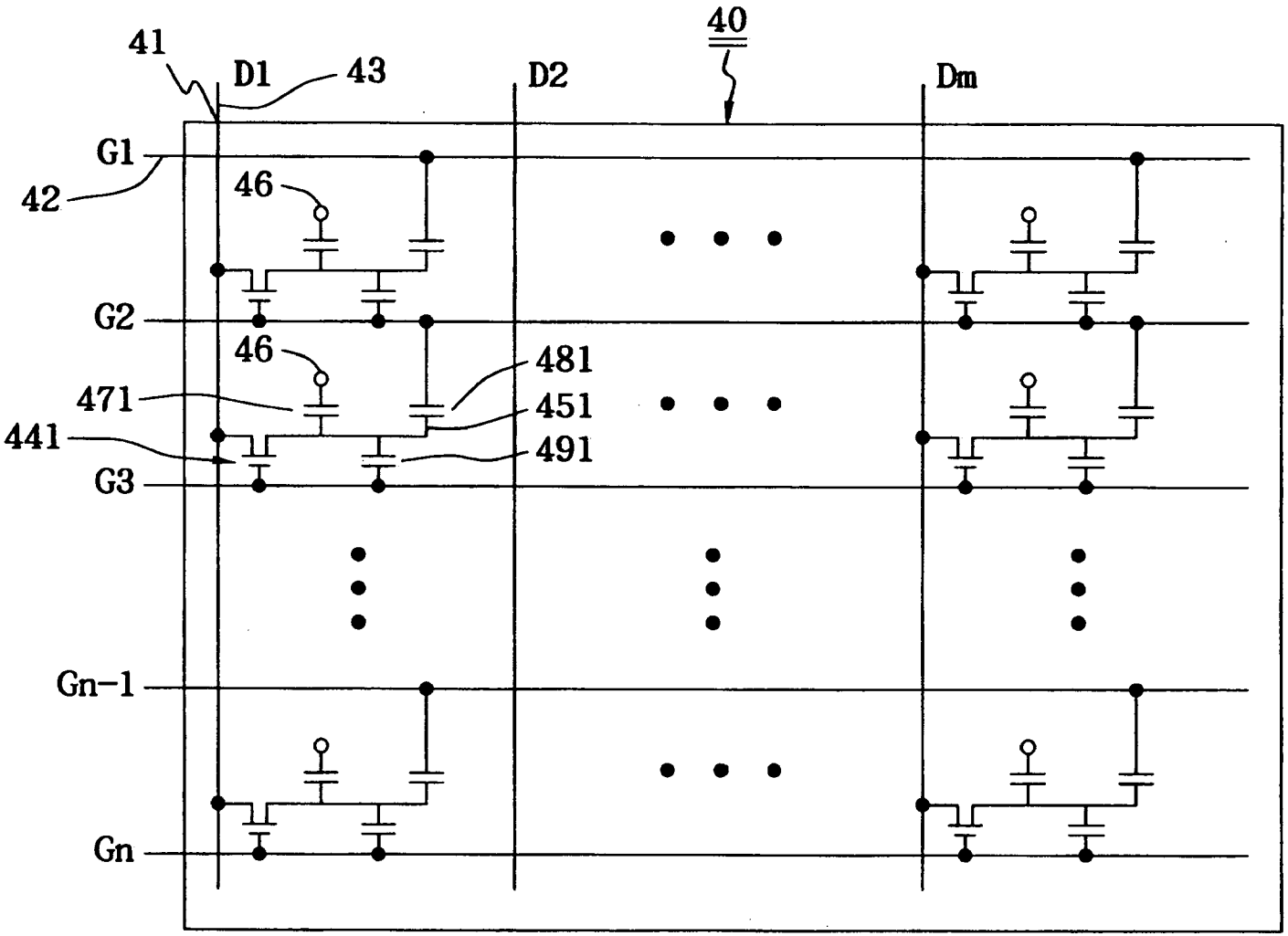
FIG. 4 shows a circuit diagram in accordance with the LCD panel of the present invention.

FIG. 4 shows a circuit diagram in accordance with the LCD panel of the present invention. An LCD panel 40 has a plurality of pixels 41 formed by a plurality of data lines D1–Dm 43 crossing a plurality of scanning lines G1–Gn 42. The storage capacitors 481 of pixels in each row are electrically connected to a previous scanning line. In other words, the scanning line G3 can turn on or turn off the TFTs 441 of the pixels in a second row, and the electrodes of the storage capacitors 481 opposite the pixel electrodes 451 are all connected to the scanning line G2. When the TFT 441 is selected to be turned on by a scanning signal, the datum of the corresponding data line 43 is written into the pixel electrode 451 so as to enable the pixel 41 to display a predetermined gradation caused from the variation of the electrical field of the LC capacitor 471 between the pixel electrode 451 and a common electrode 46.

Figure 5:
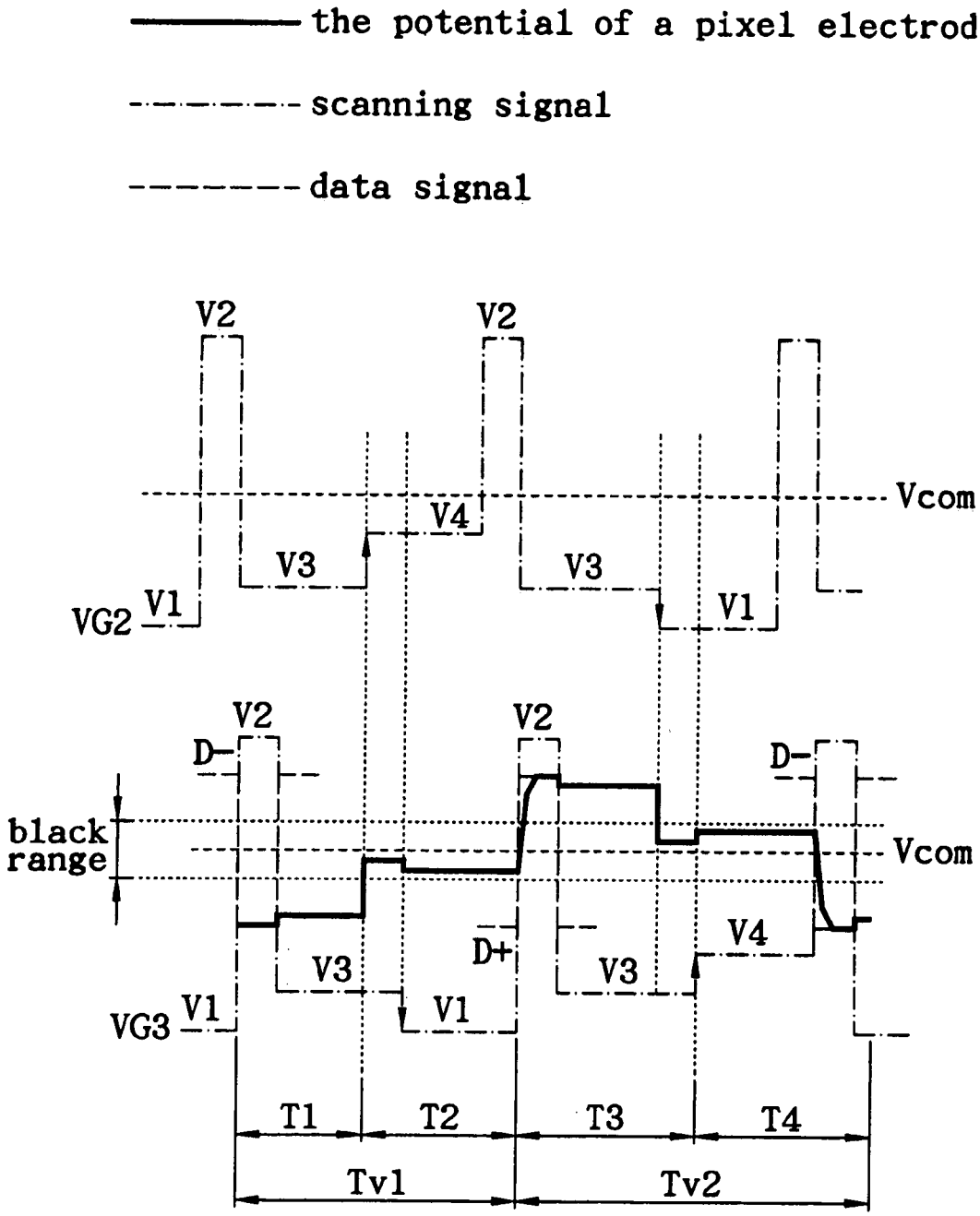
FIG. 5 shows a waveform diagram of the potential of a pixel electrode and a scanning signal in accordance with the present invention.

As to the LCD panel 40 in FIG. 4, a scanning signal consisting of four potentials is employed to make the pixels connected to a previous scanning line having desired coupled voltages, as shown in FIG.5. VG2 and VG3 respectively represent scanning signals applied to the scanning lines G2 and G3, and each the scanning signal consists of four potentials V1–V4. At the start of an interval T1, the scanning signal VG3 turns on the TFT 441 in order to write a datum D− into the pixel electrode. Meanwhile, the pixel defined as a negative polarity displays a gradation in accordance with the datum D−. At the end of the interval T1, because the potential of the scanning signal VG2 changes from V3 to V4, a capacitively coupled voltage occurs in the pixel electrode 451 that is one electrode of the storage capacitor 481 connected to the scanning line G2, and shifts the potential of the pixel electrode 451 to the black range. That is, during an interval T2 included in a vertical scanning period Tv1, a black datum is written into the pixel electrode 451. The proportion of the interval T1 to the interval T2 can affect the image quality of an LCD panel, so an optimal image quality can be obtained by tuning the duty percentage of the interval T1. The scanning signals VG1–VGn, the data signal VD and the potential Vcom are controlled by a driving circuit comprising various driving devices and logical devices.

During the manufacturing processes of the LCD panel, a capacitor $C_{gs}$ 491 deteriorating an image quality is inevitably existing between the pixel electrode 451 and the scanning line G3. When the potential of the scanning signal VG3 changes from V3 to V1 during the interval T2, another coupled voltage applied to the same pixel electrode 451 results from the existence of the capacitor $C_{gs}$ 491. Because the capacitance of the capacitor $C_{gs}$ 491 is much smaller than the one of the storage capacitor $C_{st}$ 481 ($C_{gs}$:$C_{st}$=1:6), the potential of the pixel electrode 451 is slightly shifted toward the non-block range, but still dwells in the black range.

After the next vertical scanning period Tv2, the polarity of the pixel 41 changes from negative to positive. At the start of an interval T3, because the potential of the scanning signal VG3 is shifted to V2, a datum D+ is allowed to write into the pixel electrode 451. Meanwhile, the pixel displays a gradation in accordance with the datum D+. At the end of the interval T3, because the potential of the scanning signal VG2 changes from V3 to V1, a capacitively coupled voltage occurs in the pixel electrode 451, and shifts the potential of the pixel electrode 451 to the black range. That is, during an interval t2 included in a vertical scanning period Tv2, a black datum is written into the pixel electrode 451. When the potential of the scanning signal VG3 changes from V3 to V4 during the interval T4, another smaller coupled voltage applied to the same pixel electrode 451 results from the existence of the capacitor $C_{gs}$ 491. We summarize the scanning signal VG3 as follows: The potential V2 can turn on a TFT; the potential V3 can turn off a TFT; when the potential V3 is shifted to the lower potential V1 or the higher potential V4, a capacitively coupled voltage occurs in the pixel electrode 451, but the TFT is still kept off by V1 or V4.

Figure 6:
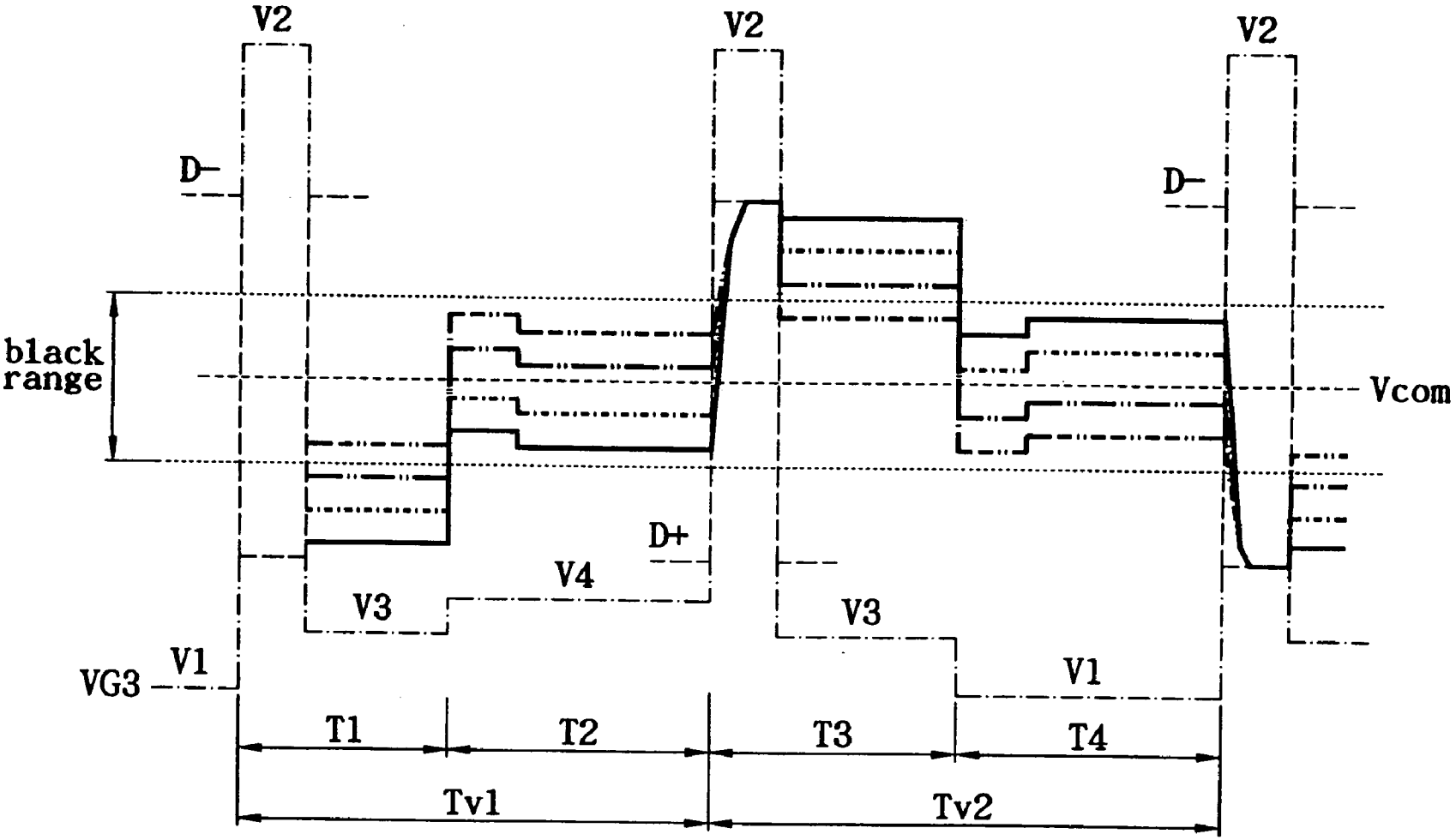
FIG. 6 shows a waveform diagram of the potentials of a pixel electrode written into various corresponding coupled voltages after various datum signals are applied.

FIG. 6 shows a waveform diagram of the potentials of a pixel electrode written into various corresponding coupled voltages after various datum signals applied. Because the black range has a wide potential range, the higher potential of the datum regarding a higher transmittance still can be shifted to the lower potential in the outer portion of the black range, even though the pixel is defined as a positive polarity during the vertical scanning period Tv1 and a negative polarity during the vertical scanning period Tv2. The various gradation voltages applied to the pixel electrode can be shifted to their corresponding potentials in the black range by mean of coupled voltages.

Figure 7:
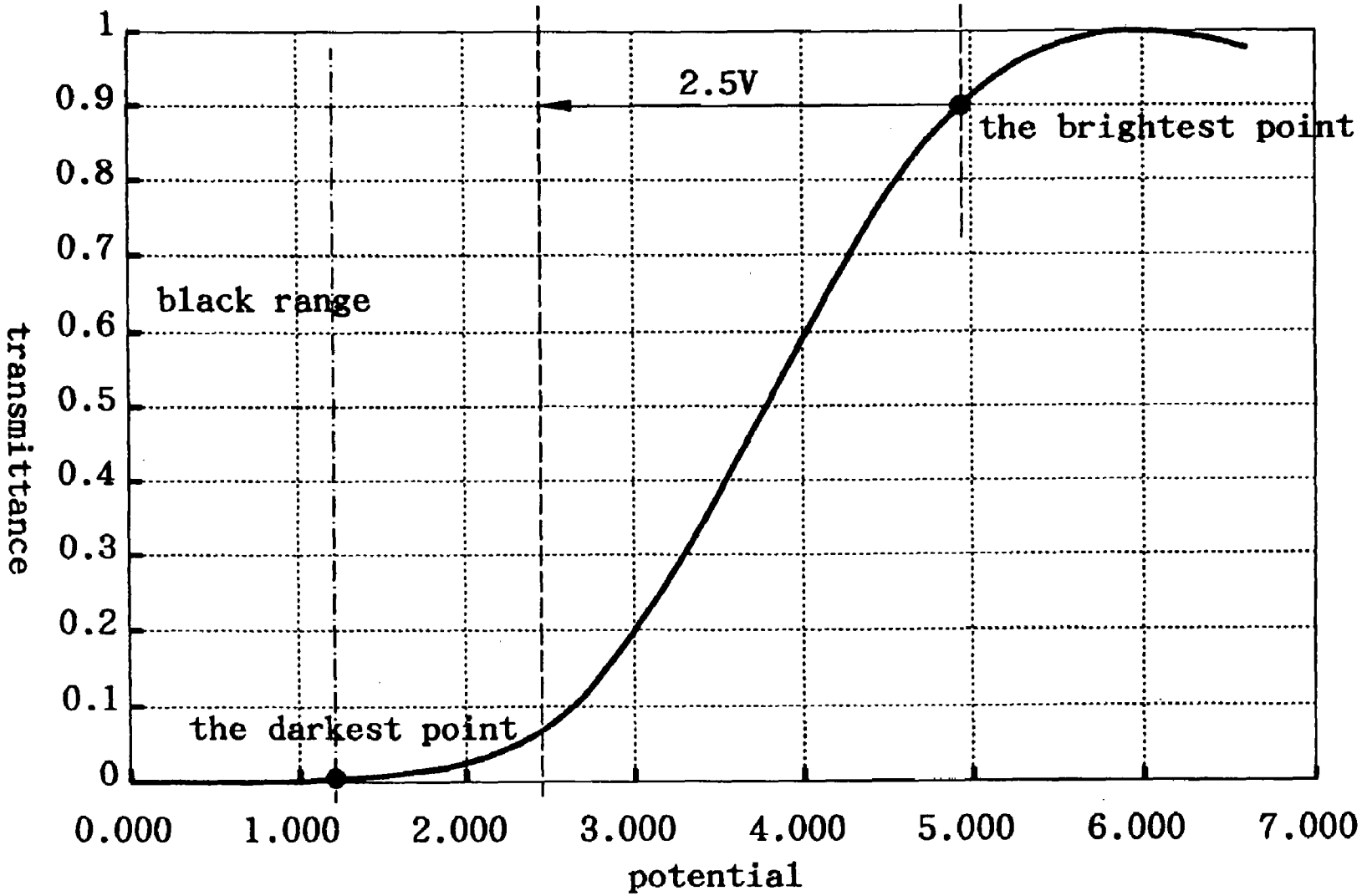
FIG. 7 shows a curve describing the relation between the potential of a pixel electrode and transmittance in accordance with the LCD panel of the present invention.

FIG. 7 shows a curve describing the relation between the potential of a pixel electrode and transmittance in accordance with the LCD panel of the present invention. The curve represents the testing result under the positive polarity of a pixel, so there is only a half of the black range 0V–1.25V. For the practical design rule of a data driver, 5V to 1.25V is regarded as a workable voltage range, and the range can be divided into numerous potential levels (e.g., 64 levels) as various gradation voltages. The point of 5V and 90% transmittance on the curve is defined as the brightest point, and another point of 1.25V and approximate 0% transmittance is defined as the darkest point. The present invention can define the magnitude of the coupled voltage as 2.5V. If the pixel electrode is written into the darkest datum of 1.25V, the potential of it will be shifted to −1.25V (negative polarity) after the coupled voltage of −2.5V being written thereon. On the other hand, if the pixel electrode is written into the brightest datum of 5V, the potential of it will be shifted to 2.5V after the coupled voltage of −2.5V being written thereon. When the pixel electrode remains the potential of 2.5V, its transmittance is around 8% close to the transmittance of a true black. Therefore, viewers always can see a sharp image.

Figure 8:
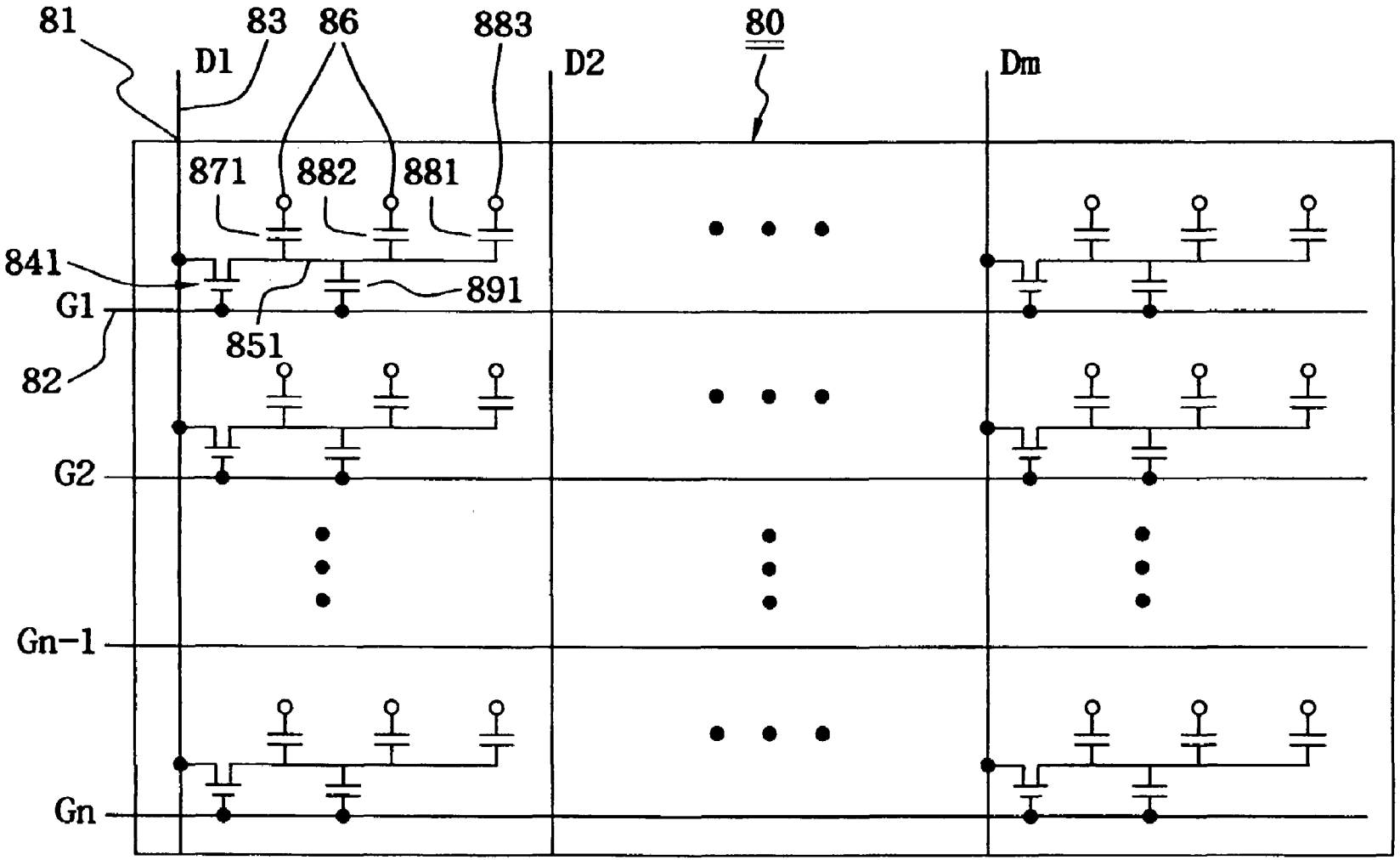
FIG. 8 shows another circuit diagram in accordance with the LCD panel of the present invention.

FIG. 8 shows another circuit diagram in accordance with the LCD panel of the present invention. An LCD panel 80 has a plurality of pixels 81 formed by a plurality of data lines D1–Dm 83 crossing a plurality of scanning lines G1–Gn 82. The first storage capacitors 881 of pixels in each row are electrically connected to a scanning line 883. A signal source (not shown) applies a driving signal to the scanning line 883. When the TFT 841 is selected to be turned on by a scanning signal, the datum of the corresponding data line 83 is written into the pixel electrode 851 so as to enable the pixel 81 to display a predetermined gradation caused from the variation of the electrical field of the LC capacitor 871 between the pixel electrode 851 and a common electrode 86. Each of the pixels 81 further comprises a second storage capacitor 882 whose one electrode is electrically connected to the common electrode 86. A capacitor $C_{gs}$ 891 deteriorating an image quality exists between the pixel electrode 851 and the scanning line G2, and has the same electrical characteristics as the capacitor $C_{gs}$ 491 in FIG. 4.

Figure 9:
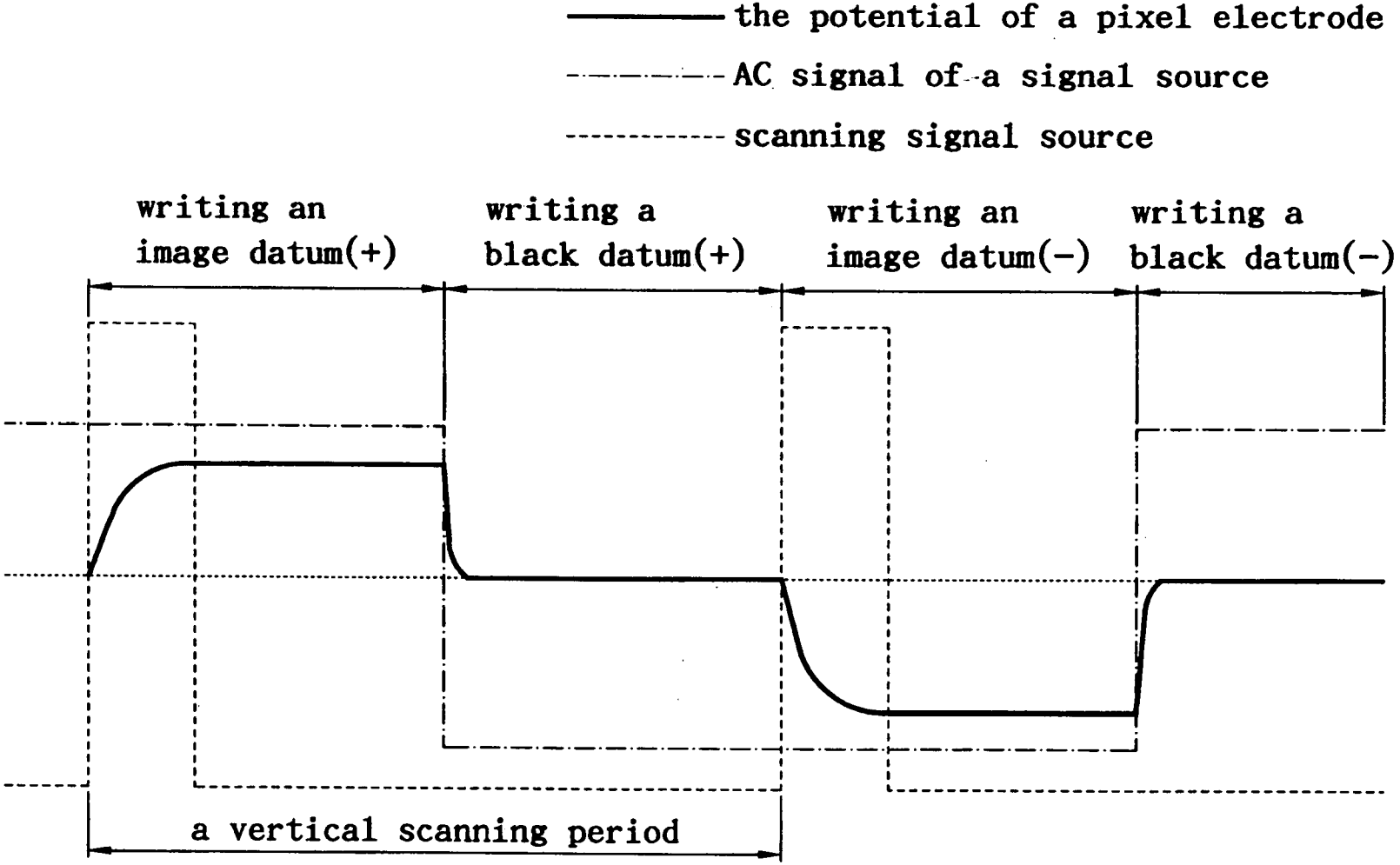
FIG. 9 shows a waveform diagram of the AC signal of the signal source in FIG. 8.

In comparison with the LCD panel 40 in FIG. 4, the LCD panel 80 in FIG. 8 can offer the coupled voltage without modifying the scanning signal. That is, a black datum can be written into a pixel on a lack of specific driving devices consisting four potentials. It employs the AC signal of a signal source for the potential of the pixel electrode 851 to be shifted to the black range from a coupled voltage, as shown in FIG.9. During the following half of a vertical scanning period, because the potential of the AC signal changes from high to its slice level, the pixel electrode 851 connected to the first storage 881 has a coupled voltage to change the image datum from positive to zero. The pixel changes its polarity from positive to negative when the succeeding vertical scanning period comes. Meanwhile, the shape of the succeeding waveform is contrary to and a mirror curve of the one of the previous waveform.

The present invention can increase the charging time of the pixel electrode to 10 μsec for a WUGA type LCD panel. In contrast with a prior art having the maximum charging time of 5 μsec, the present invention actually has a more uniform charging effect and better image quality. On the other hand, the prior art needs to employ a scanning driving device with a frequency double higher than the present invention. Apparently, the present invention does has superior characteristics.

The above-described embodiments of the present invention are intended to be illustrative only. Numerous alternative embodiments may be devised by persons skilled in the art without departing from the scope of the following claims.

What is claimed is:

1. An liquid crystal display panel, comprising:

a plurality of data lines;

a plurality of scanning lines;

a common electrode;

a plurality of pixels positioned on intersections of the scanning lines and the data lines, each of the plurality of pixels including:

a thin film transistor electrically connected to the data line and the scanning line;

a pixel electrode electrically connected to the thin film transistor;

a liquid crystal capacitor whose two terminals are separately connected to the pixel electrode and the common electrode; and a first storage capacitor whose one terminal is electrically connected to the pixel electrode; and a plurality of driving signals to the data lines, the scanning lines, the common electrode and the other terminal of the first storage capacitor;

wherein the potential of the driving signal applied to the first storage capacitor varies during a vertical scanning period so as to generate a coupled voltage on the pixel electrode for displaying substantial black.

2. The liquid crystal display panel of claim 1, wherein the first storage capacitor and the scanning line are applied by the same driving signal.

3. The liquid crystal display panel of claim 2, wherein the driving signal is an electrical signal having four potentials, wherein two of the four potentials are used to turn on/off the thin film transistor and the other two potentials are used to control the generation of the coupled voltage.

4. The liquid crystal display panel of claim 3, wherein the two potentials for controlling the generation of the coupled voltage respectively act when the pixel is in the state of positive or negative polarities.

5. The liquid crystal display panel of claim 1, wherein the pixel further comprises a second storage capacitor electrically connected to the pixel electrode and the common electrode.

6. The liquid crystal display panel of claim 1, wherein the driving signal applied to the first storage capacitor is an AC signal with square pulses which changes from high/low potential to its slice level during the vertical scanning period.

7. The liquid crystal display panel of claim 6, wherein the potential of the driving signal falls during the vertical scanning period to have the negative coupled voltage formed on the pixel electrode when the pixel is in the state of positive polarity.

8. The liquid crystal display panel of claim 6, wherein the potential of the driving signal rises during the vertical scanning period to have the positive coupled voltage formed on the pixel electrode when the pixel is in the state of negative polarity.

9. A driving method for a liquid crystal display panel including a plurality of scanning lines, a plurality of data lines crossing the scanning lines, a matrix of pixels having first storage capacitors connected with pixel electrodes and the scanning lines, comprising the steps of:

defining a black range having upper and lower threshold potentials for the pixel electrodes of the liquid crystal display panel, wherein the black range is for displaying substantial black;

driving the scanning lines by scanning signals to separately allow a data signal from the data line to be written into the pixel electrode during a first interval; and driving the scanning lines by the scanning signals to separately induce a coupled voltage to change the potential of the pixel electrode into the black range during a second interval.

10. The driving method for a liquid crystal display panel of claim 9, wherein the potential of the scanning signal is instantaneously decreased to induce the coupled voltage on the pixel electrode for changing the potential of the pixel electrode into the black range during the second interval if the polarity of the pixel is positive.

11. The driving method for a liquid crystal display panel of claim 9, wherein the potential of the scanning signal is instantaneously increased to induce the coupled voltage on the pixel electrode for changing the potential of the pixel electrode into the black range during the second interval if the polarity of the pixel is negative.

12. The driving method for a liquid crystal display panel of claim 9, wherein the storage capacitor of the pixel is connected to the scanning line adjacent to the pixel.

13. The driving method for a liquid crystal display panel of claim 9, wherein the scanning signal has four potential levels.

14. The driving method for a liquid crystal display panel of claim 13, wherein two of the four potential levels can result in the occurrence of the coupled voltage.

15. The driving method for a liquid crystal display panel of claim 9, wherein the first interval and the second interval are equal to a vertical scanning period.

16. The driving method for a liquid crystal display panel of claim 9, wherein the scanning signal applied to the scanning line is an AC signal with square pulse.

17. The driving method for a liquid crystal display panel of claim 9, wherein the pixel further comprise a second storage capacitor electrically connected to a common electrode and the pixel electrode.

* * * * *